US009551959B2

(12) United States Patent
Kikuchi et al.

(10) Patent No.: US 9,551,959 B2
(45) Date of Patent: Jan. 24, 2017

(54) IMAGE FORMING APPARATUS FORMING TONER IMAGE ON SURFACE LAYER PORTION OF IMAGE CONVEYING PORTION

(71) Applicant: KYOCERA Document Solutions Inc., Osaka-shi, Osaka (JP)

(72) Inventors: Einosuke Kikuchi, Osaka (JP); Akira Matayoshi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/012,693

(22) Filed: Feb. 1, 2016

(65) Prior Publication Data

US 2016/0223951 A1 Aug. 4, 2016

(30) Foreign Application Priority Data

Feb. 4, 2015 (JP) ..... 2015-020080

(51) Int. Cl.
*G03G 15/16* (2006.01)
*G03G 15/08* (2006.01)

(52) U.S. Cl.
CPC ..... *G03G 15/1605* (2013.01); *G03G 15/0891* (2013.01)

(58) Field of Classification Search
None
See application file for complete search history.

(56) References Cited

U.S. PATENT DOCUMENTS

2004/0141770 A1* 7/2004 Maeda ..... G03G 15/0291 399/159
2007/0154239 A1* 7/2007 Fukunaga ..... G03G 15/751 399/159
2009/0148201 A1* 6/2009 Sawai ..... G03G 15/162 399/302
2010/0316420 A1* 12/2010 Mori ..... G03G 15/162 399/302

(Continued)

FOREIGN PATENT DOCUMENTS

JP 2003270962 A 9/2003

*Primary Examiner* — David Gray
*Assistant Examiner* — Thomas Giampaolo, II
(74) *Attorney, Agent, or Firm* — Alleman Hall McCoy Russell & Tuttle LLP

(57) ABSTRACT

An image forming apparatus includes a toner containing portion, a first conveying member, an image conveying portion, and an image forming portion. The first conveying member is configured to convey the toner in a conveyance direction within the toner containing portion. The image conveying portion includes a surface layer portion having a first end portion located at an upstream side in the conveyance direction and a second end portion located at a downstream side in the conveyance direction. The first end portion has a larger layer thickness than second end portion. The image conveying portion is configured to convey a toner image formed on a surface of the surface layer portion at a predetermined image forming position, to a transfer position for transfer to a transfer target medium. The image forming portion is configured to form the toner image on the surface layer portion by using the toner being conveyed.

6 Claims, 4 Drawing Sheets

(56) References Cited

U.S. PATENT DOCUMENTS

| | | | | |
|---|---|---|---|---|
| 2012/0183334 | A1* | 7/2012 | Sasaki | G03G 15/0839 399/258 |
| 2013/0071145 | A1* | 3/2013 | Toichi | G03G 15/0812 399/267 |

* cited by examiner

IMAGE FORMING APPARATUS FORMING TONER IMAGE ON SURFACE LAYER PORTION OF IMAGE CONVEYING PORTION

INCORPORATION BY REFERENCE

This application is based upon and claims the benefit of priority from the corresponding Japanese Patent Application No. 2015-020080 filed on Feb. 4, 2015, the entire contents of which are incorporated herein by reference.

BACKGROUND

The present disclosure relates to an image forming apparatus capable of forming an image by electrophotography.

An image forming apparatus, such as a printer, which is capable of forming an image by electrophotography is known. The image forming apparatus forms a toner image on an image conveying portion such as an intermediate transfer belt. For example, the intermediate transfer belt includes a base layer portion and a surface layer portion. For example, the base layer portion is formed of a thermoplastic resin, and, as the surface layer portion, a thermosetting resin which is a surface layer material is coated on the base layer portion. As a method for coating the surface layer material onto the intermediate transfer belt, a dipping method or a ring coating method is known.

In such an image forming apparatus, toner is supplied from a developing device to an image carrier such as a photosensitive drum. Accordingly, the toner adheres to an electrostatic latent image formed on the image carrier, whereby the electrostatic latent image is developed. For example, the toner contained within the developing device is conveyed so as to be circulated within the developing device by a conveying member such as an agitating screw, and is also charged by agitation. Then, the toner within the developing device is supplied to the image carrier by a developing roller provided along a direction of conveyance of the toner by the conveying member.¥

SUMMARY

An image forming apparatus according to the present disclosure includes a toner containing portion, a first conveying member, an image conveying portion, and an image forming portion. The toner containing portion is configured to contain toner. The first conveying member is configured to convey the toner in a predetermined conveyance direction within the toner containing portion. The image conveying portion includes a surface layer portion having a first end portion located at an upstream side in the conveyance direction and a second end portion located at a downstream side in the conveyance direction. The first end portion has a larger layer thickness than the second end portion. The image conveying portion is configured to convey a toner image formed on a surface of the surface layer portion at a predetermined image forming position, to a transfer position for transfer to a transfer target medium. The image forming portion is configured to form the toner image on the surface layer portion of the image conveying portion by using the toner being conveyed by the first conveying member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the accompanying drawings in order to allow understanding of the present disclosure. It should be noted that the following embodiment is an example embodying the present disclosure and does not limit the technical scope of the present disclosure.

Schematic Configuration of Image Forming Apparatus 10

First, the configuration of an image forming apparatus 10 according to the embodiment of the present disclosure will be described with reference to FIG. 1. Here, FIG. 1 is a schematic cross-sectional view showing the configuration of the image forming apparatus 10.

Figure 1:
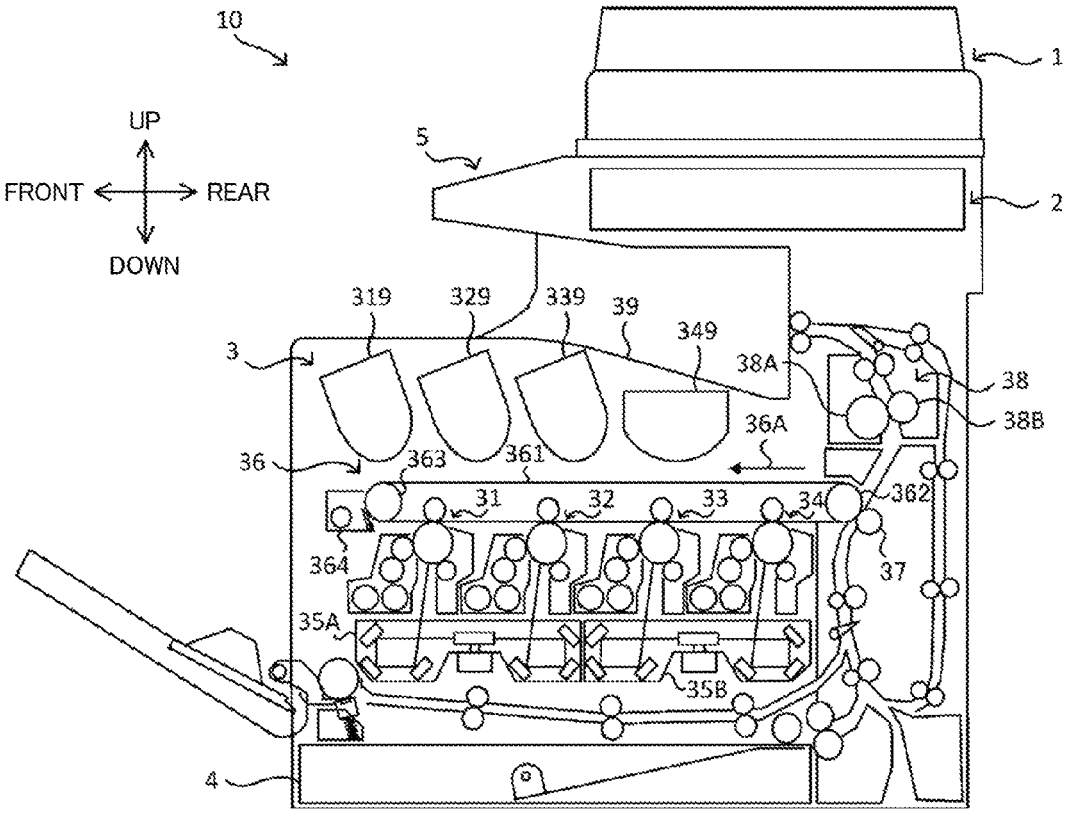
FIG. 1 is a diagram showing the configuration of an image forming apparatus according to an embodiment of the present disclosure.

As shown in FIG. 1, the image forming apparatus 10 includes an ADF 1, an image reading portion 2, an image forming portion 3, a sheet feed portion 4, and an operation display portion 5. The image forming apparatus 10 is a multifunction peripheral having a plurality of functions such as a printer function to form an image on the basis of image data as well as a scanning function, a facsimile function, a copy function, or the like. In addition, the present disclosure is applicable to image forming apparatuses such as a printer apparatus, a facsimile apparatus, and a copy machine.

The ADF 1 is an automatic document feeder which includes a document set portion, a plurality of conveying rollers, a document holder, and a sheet discharge portion, which are not shown, and conveys a document sheet to be read by the image reading portion 2. The image reading portion 2 includes a document table, a light source, and a plurality of mirrors, an optical lens, and a CCD, which are not shown, and is capable of reading image data from a document sheet.

The operation display portion 5 includes: a display portion, such as a liquid crystal display, which displays various kinds of information in accordance with control instructions from a control portion which is not shown; and an operation portion, such as an operation key or a touch panel, which inputs various kinds of information into the control portion in accordance with user operations.

Figure 2:
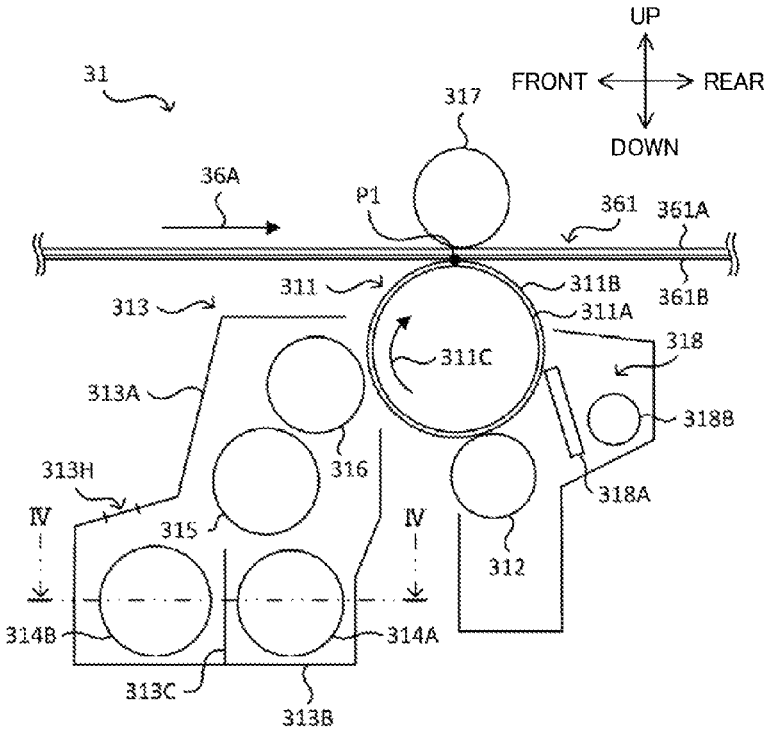
FIG. 2 is a diagram showing the configuration of an image forming unit of the image forming apparatus according to the embodiment of the present disclosure.
Figure 3:
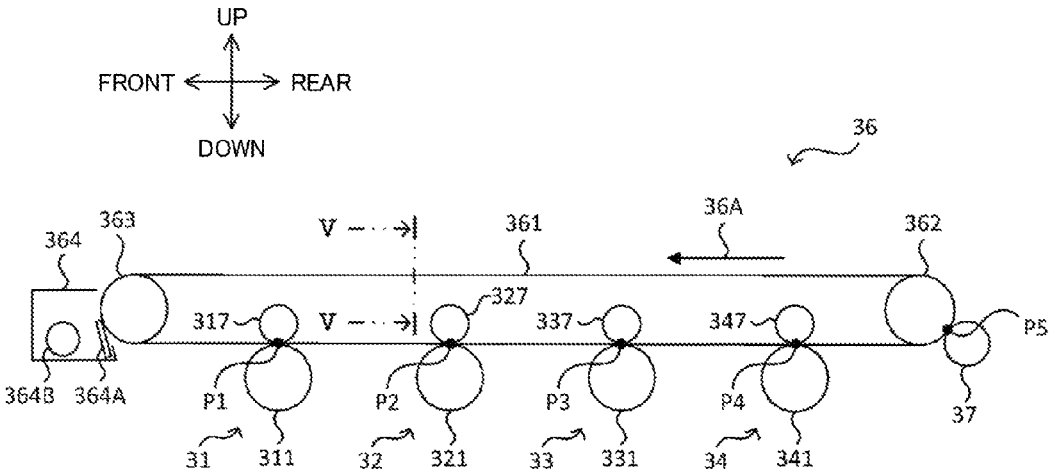
FIG. 3 is a diagram showing the configuration of an intermediate transfer device of the image forming apparatus according to the embodiment of the present disclosure.

Next, the image forming portion 3 will be described with reference to FIGS. 1 to 3. Here, FIG. 2 is a schematic cross-sectional view showing the configuration of an image forming unit 31. FIG. 3 is a schematic cross-sectional view showing the configuration of an intermediate transfer device 36.

The image forming portion 3 is capable of executing an image forming process (printing process) of forming a color or monochrome image by electrophotography on the basis of image data read by the image reading portion 2. In addition, the image forming portion 3 is also capable of executing the printing process on the basis of image data inputted from an information processing apparatus such as an external personal computer.

Specifically, as shown in FIG. 1, the image forming portion 3 includes a plurality of image forming units 31 to 34, laser scanning units 35A and 35B, the intermediate transfer device 36, a secondary transfer roller 37, a fixing device 38, and a sheet discharge tray 39.

The image forming unit 31 is an electrophotographic type image forming unit corresponding to Y (yellow), the image forming unit 32 is an electrophotographic type image forming unit corresponding to C (cyan), the image forming unit 33 is an electrophotographic type image forming unit corresponding to M (magenta), and the image forming unit 34 is an electrophotographic type image forming unit corresponding to K (black). As shown in FIG. 1, the image forming units 31 to 34 are provided so as to be aligned along the front-rear direction of the image forming apparatus 10 in order of yellow, cyan, magenta, and black from the front of the image forming apparatus 10.

As shown in FIGS. 1 and 2, the image forming unit 31 includes a photosensitive drum 311, a charging roller 312, a developing device 313, a primary transfer roller 317, a drum cleaning portion 318, and a toner supply portion 319.

An electrostatic latent image is formed on the surface of the photosensitive drum 311. Specifically, as shown in FIG. 2, the photosensitive drum 311 includes a base portion 311A and a photosensitive layer portion 311B. For example, the base portion 311A is an element tube made of aluminum. The photosensitive layer portion 311B is formed by coating, on the surface of the base portion 311A, an organic photosensitive material composed of an organic compound that improves conductivity when being irradiated with light. The photosensitive drum 311 rotates along a rotation direction 311C shown in FIG. 2 by a driving force supplied from a power source which is not shown. Here, the photosensitive drum 311 is an example of an image carrier in the present disclosure.

The charging roller 312 charges the photosensitive layer portion 311B of the photosensitive drum 311. For example, as shown in FIG. 2, the charging roller 312 is provided in contact with the photosensitive layer portion 311B. A voltage is applied to the charging roller 312 from a power supply device which is not shown. Accordingly, a discharge occurs between the charging roller 312 and the photosensitive layer portion 311B to charge the photosensitive layer portion 311B.

The developing device 313 develops an electrostatic latent image formed on the photosensitive layer portion 311B of the photosensitive drum 311, by using yellow toner. The toner supply portion 319 supplies the yellow toner to the developing device 313. The developing device 313 and the toner supply portion 319 will be described later.

The primary transfer roller 317 transfers a toner image formed on the surface of the photosensitive layer portion 311B of the photosensitive drum 311 by the developing device 313, onto an intermediate transfer belt 361 of the intermediate transfer device 36 described later. For example, as shown in FIG. 2, the primary transfer roller 317 is provided in contact with the intermediate transfer belt 361. A voltage is applied to the primary transfer roller 317 from the power supply device which is not shown. Accordingly, an electric field is formed between the primary transfer roller 317 and the photosensitive layer portion 311B to transfer the toner image formed on the surface of the photosensitive layer portion 311B, onto the surface of the intermediate transfer belt 361. Here, the primary transfer roller 317 is an example of a second transfer member in the present disclosure.

The drum cleaning portion 318 removes the toner remaining on the surface of the photosensitive layer portion 311B of the photosensitive drum 311. For example, at the drum cleaning portion 318, the toner remaining on the surface of the photosensitive layer portion 311B is removed by a blade-like cleaning member 318A. Then, the toner removed by the cleaning member 318A is conveyed to a toner receiving container, which is not shown, by a conveyance screw 318B and collected therein.

The image forming units 32 to 34 have the same configuration as the image forming unit 31. That is, as shown in FIGS. 1 and 3, the image forming units 32 to 34 include photosensitive drums 321 to 341, primary transfer rollers 327 to 347, and toner supply portions 329 to 349. Here, the photosensitive drums 311 to 341 are an example of a plurality of image carriers in the present disclosure. The primary transfer rollers 317 to 347 are an example of a plurality of second transfer members in the present disclosure.

The laser scanning units 35A and 35B form electrostatic latent images on the respective photosensitive layer portions of the photosensitive drums 311 to 341. Specifically, as shown in FIG. 1, the laser scanning unit 35A is provided in corresponding relation to the photosensitive drums 311 and 321 of the image forming units 31 and 32. The laser scanning unit 35B is provided in corresponding relation to the photosensitive drums 331 and 341 of the image forming units 33 and 34. The laser scanning unit 35A applies light based on image data to the photosensitive layer portion 311B of the photosensitive drum 311 that has been charged by the charging roller 312. Accordingly, an electrostatic latent image corresponding to the image data is formed on the photosensitive layer portion 311B.

The intermediate transfer device 36 conveys a toner image transferred from the photosensitive drums 311 to 341 onto the intermediate transfer belt 361, by using the intermediate transfer belt 361. As shown in FIGS. 1 and 3, the intermediate transfer device 36 includes the intermediate transfer belt 361, a driving roller 362, an extending roller 363, and a belt cleaning portion 364.

The intermediate transfer belt 361 is an endless belt member onto which toner images formed on the respective photosensitive layer portions of the photosensitive drums 311 to 341 are transferred. Here, the intermediate transfer belt 361 is an example of an intermediate transfer medium in the present disclosure and is an example of an image conveying portion in the present disclosure.

Specifically, as shown in FIG. 2, the intermediate transfer belt 361 includes a base layer portion 361A and a surface layer portion 361B. The base layer portion 361A is formed of a thermoplastic resin. For example, the thermoplastic resin is polycarbonate (PC), polyvinylidene fluoride (PVDF), nylon (PA), polybutylene terephthalate (PBT), or the like. The surface layer portion 361B is formed by coating a thermosetting resin on the base layer portion 361A. For example, the thermosetting resin is polyimide (PI), polyamide imide (PAI), acrylic (AC), or the like. The method for forming the surface layer portion 361B will be described later.

As shown in FIGS. 1 and 3, the intermediate transfer belt 361 is extended by the driving roller 362 and the extending roller 363 which are disposed so as to be spaced apart from each other in the front-rear direction of the image forming apparatus 10. Specifically, the intermediate transfer belt 361 is extended in a state where the base layer portion 361A is in contact with the driving roller 362 and the extending roller 363. In addition, the primary transfer rollers 317 to 347 of the image forming units 31 to 34 are disposed in a state of being in contact with the base layer portion 361A of the intermediate transfer belt 361. Moreover, the respective photosensitive layer portions of the photosensitive drums 311 to 341 of the image forming units 31 to 34 are disposed in a state of being in contact with the surface layer portion 361B of the intermediate transfer belt 361.

The driving roller 362 is rotationally driven by a driving force supplied from the power source which is not shown, to cause the intermediate transfer belt 361 to run. Accordingly, as shown in FIGS. 1 to 3, the intermediate transfer belt 361 runs along a conveyance direction 36A which is the same as the front-rear direction of the image forming apparatus 10. That is, the intermediate transfer belt 361 conveys the toner images transferred from the photosensitive drums 311 to 341 onto the surface layer portion 361B.

The belt cleaning portion 364 removes the toner remaining on the surface of the surface layer portion 361B of the intermediate transfer belt 361. For example, at the belt cleaning portion 364, the toner remaining on the surface of the surface layer portion 361B is removed by a blade-like cleaning member 364A. Then, the toner removed by the cleaning member 364A is conveyed to a toner receiving container, which is not shown, by a conveyance screw 364B and collected therein.

The secondary transfer roller 37 transfers the toner images attached to the surface of the surface layer portion 361B of the intermediate transfer belt 361, onto a sheet. For example, as shown in FIG. 3, the secondary transfer roller 37 is provided in contact with the intermediate transfer belt 361. A voltage is applied to the secondary transfer roller 37 from the power supply device which is not shown. Accordingly, an electric field is formed between the secondary transfer roller 37 and the surface layer portion 361B to transfer the toner images attached to the surface of the surface layer portion 361B, onto the sheet. Here, the secondary transfer roller 37 is an example of a first transfer member in the present disclosure.

The fixing device 38 melts and fixes the toner images transferred onto the sheet by the secondary transfer roller 37, on the sheet. For example, the fixing device 38 includes a fixing roller 38A and a pressure roller 38B. The fixing roller 38A is provided in contact with the pressure roller 38B, and heats the toner images transferred onto the sheet, to fix the toner images on the sheet. The pressure roller 38B pressurizes the sheet passing through a contact portion formed between the fixing roller 38A and the pressure roller 38B.

The sheet on which the toner images have been fixed by the fixing device 38 is discharged to the sheet discharge tray 39.

At the image forming portion 3, a color image is formed on a sheet supplied from the sheet feed portion 4, by the following procedure. The sheet is a sheet material such as paper, coated paper, a postcard, an envelope, an OHP sheet, or the like.

First, at the image forming unit 31, the surface of the photosensitive layer portion 311B of the photosensitive drum 311 is uniformly charged at a predetermined potential by the charging roller 312. Light based on image data is applied by the laser scanning unit 35A to the surface of the photosensitive layer portion 311B that has been charged by the charging roller 312. Accordingly, an electrostatic latent image corresponding to the image data is formed on the surface of the photosensitive layer portion 311B. The electrostatic latent image formed on the surface of the photosensitive layer portion 311B is developed (visualized) as a yellow toner image by the developing device 313.

The yellow toner image formed on the surface of the photosensitive layer portion 311B is conveyed by the photosensitive drum 311 to a primary transfer position P1 for primary transfer by the primary transfer roller 317. Here, as shown in FIG. 2, the primary transfer position P1 is a position at which the surface of the photosensitive layer portion 311B and the surface layer portion 361B of the intermediate transfer belt 361 are in contact with each other. At the primary transfer position P1, the primary transfer roller 317 transfers the yellow toner image formed on the surface of the photosensitive layer portion 311B, onto the surface of the surface layer portion 361B of the intermediate transfer belt 361. Here, the primary transfer position P1 is an example of an image forming position in the present disclosure. The toner remaining on the surface of the photosensitive layer portion 311B is removed by the drum cleaning portion 318.

Next, also at the image forming units 32 to 34, toner images of the corresponding colors are formed on the surfaces of the respective photosensitive layer portions of the photosensitive drums 321 to 341 by the same processing procedure as in the image forming unit 31. Then, at primary transfer positions P2 to P4 shown in FIG. 3, the toner images of the corresponding colors formed on the surfaces of the respective photosensitive layer portions of the photosensitive drums 321 to 341 are transferred onto the surface of the surface layer portion 361B of the intermediate transfer belt 361 by the primary transfer rollers 327 to 347, respectively. Here, the primary transfer positions P1 to P4 are an example of a plurality of image forming positions in the present disclosure. Accordingly, the toner images of the corresponding colors formed on the photosensitive drums 311 to 341 are overlaid and transferred on the surface of the surface layer portion 361B in order of yellow, cyan, magenta, and black.

The toner images transferred onto the surface of the surface layer portion 361B by the image forming units 31 to 34 are conveyed by the intermediate transfer belt 361 to a secondary transfer position P5 for secondary transfer by the secondary transfer roller 37. Here, as shown in FIG. 3, the secondary transfer position P5 is a position at which the intermediate transfer belt 361 and the secondary transfer roller 37 are in contact with each other. At the secondary transfer position P5, the secondary transfer roller 37 transfers the toner images attached to the surface of the surface layer portion 361B of the intermediate transfer belt 361, onto a sheet supplied from the sheet feed portion 4. Here, the secondary transfer position P5 is an example of a transfer position in the present disclosure. The sheet is an example of a transfer target medium in the present disclosure.

Thereafter, on the sheet onto which the toner images have been transferred, an image is formed by the toner images being melted and fixed by the fixing device 38. The sheet on which the image has been formed is discharged to the sheet discharge tray 39.

Next, the developing device 313 and the toner supply portion 319 will be described with reference to FIGS. 1, 2, and 4. Here, FIG. 4 is a cross-sectional view as seen from the direction of arrows IV in FIG. 2.

The developing device 313 develops an electrostatic latent image formed on the surface of the photosensitive layer portion 311B of the photosensitive drum 311, by using the yellow toner. Specifically, as shown in FIGS. 2 and 4, the developing device 313 includes a housing 313A, a first conveying member 314A, a second conveying member 314B, a magnet roller 315, and a developing roller 316.

As shown in FIG. 2, the housing 313A contains the first conveying member 314A, the second conveying member 314B, the magnet roller 315, and the developing roller 316. In addition, the housing 313A contains a developer including toner and a carrier. Specifically, the housing 313A contains the developer in an internal space formed by a side wall and a bottom surface 313B. Here, the housing 313A is an example of a toner containing portion in the present disclosure.

Figure 4:
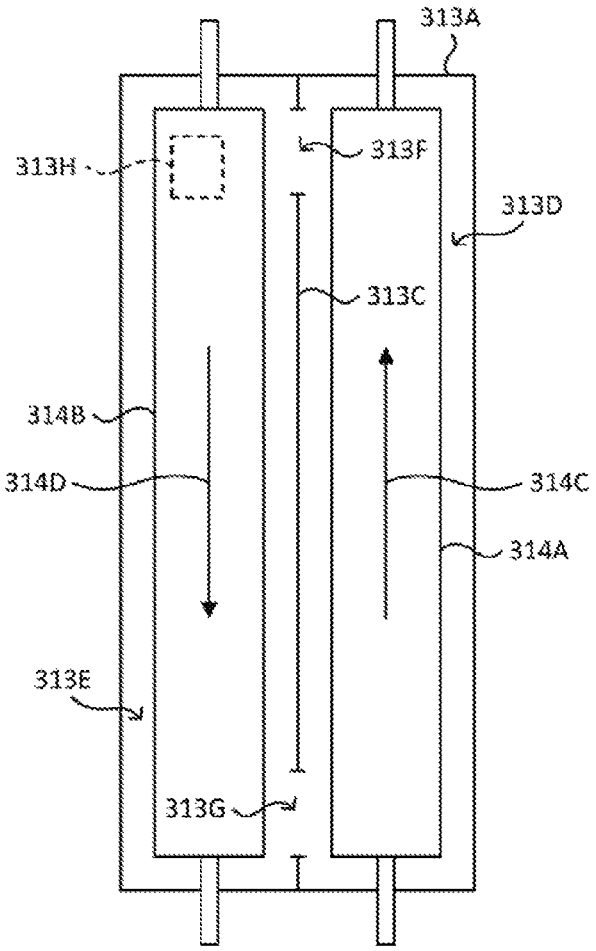
FIG. 4 is a diagram showing the configuration of a toner containing portion of the image forming apparatus according to the embodiment of the present disclosure.

As shown in FIG. 4, the first conveying member 314A conveys the developer in a conveyance direction 314C within the housing 313A and charges the toner included in the developer. Specifically, the first conveying member 314A agitates the developer while conveying the developer, to charge the toner included in the developer. For example, the first conveying member 314A is an agitating screw. Here, the conveyance direction 314C is an example of a predetermined conveyance direction in the present disclosure.

As shown in FIG. 4, the second conveying member 314B conveys the developer in a conveyance direction 314D opposite to the conveyance direction 314C, within the housing 313A, and charges the toner included in the developer. Specifically, the second conveying member 314B agitates the developer while conveying the developer, to charge the toner included in the developer. For example, the second conveying member 314B is an agitating screw.

Here, the developer contained in the housing 313A is conveyed so as to be circulated within the housing 313A by the first conveying member 314A and the second conveying member 314B. Specifically, as shown in FIGS. 2 and 4, a separation wall 313C is provided on the bottom surface 313B of the housing 313A. A first containing portion 313D in which the developer and the first conveying member 314A are contained is formed within the housing 313A by the side wall, the bottom surface 313B, and the separation wall 313C of the housing 313A. In addition, a second containing portion 313E in which the developer and the second conveying member 314B are contained is formed within the housing 313A by the side wall of the housing 313A, the bottom surface 313B, and the separation wall 313C.

A first connection portion 313F connection the first containing portion 313D and the second containing portion 313E is provided at the downstream side of the separation wall 313C in the conveyance direction 314C. Meanwhile, a second connection portion 313G connecting the first containing portion 313D and the second containing portion 313E is provided at the upstream side of the separation wall 313C in the conveyance direction 314C. Accordingly, the developer contained in the housing 313A is conveyed so as to be circulated through the first containing portion 313D and the second containing portion 313E by the first conveying member 314A and the second conveying member 314B. Therefore, an electric charge amount of the toner included in the developer contained in the housing 313A is gradually made uniform while being conveyed so as to be circulated by the first conveying member 314A and the second conveying member 314B.

The magnet roller 315 acquires the developer conveyed by the first conveying member 314A, from a direction perpendicular to the conveyance direction 314C. Then, the magnet roller 315 supplies the toner included in the developer acquired from the first conveying member 314A, to the developing roller 316. The developing roller 316 develops an electrostatic latent image formed on the surface of the photosensitive layer portion 311B of the photosensitive drum 311, by using the toner supplied from the magnet roller 315. Here, the magnet roller 315 and the developing roller 316 are an example of a developing portion in the present disclosure. The photosensitive drum 311, the magnet roller 315, the developing roller 316, and the primary transfer roller 317 are an example of an image forming portion in the present disclosure.

The method of the development by the developing device 313 is not limited to the above-described two-component development method using the developer including the toner and the carrier. For example, the method of the development by the developing device 313 may be a one-component development method using only toner. In addition, the developing device 313 may not include the magnet roller 315.

The toner supply portion 319 supplies the yellow toner to the housing 313A of the developing device 313. For example, a density detection sensor which detects the density of the toner in the developer contained in the housing 313A and is not shown is provided in the housing 313A. The control portion transmits a control signal that instructs the toner supply portion 319 to supply the toner, in accordance with an output signal from the density detection sensor. The toner supply portion 319 supplies the toner to the developing device 313 in accordance with the control signal transmitted from the control portion.

Next, the method for forming the surface layer portion 361B of the intermediate transfer belt 361 will be described with reference to FIG. 5. Here, FIG. 5 is a cross-sectional view as seen from the direction of arrows V in FIG. 3.

In the image forming apparatus 10, the surface layer portion 361B of the intermediate transfer belt 361 is formed by a ring coating method. Here, the ring coating method is a method in which, while a ring-shaped coating device or an object is moved in the vertical direction, a coating material emitted from the inner peripheral side of the coating device is applied to the surface of the object. The use of the ring coating method as the method for forming the surface layer portion 361B of the intermediate transfer belt 361 allows the productivity of the intermediate transfer belt 361 to be improved as compared to the case of using another method such as a spray coating method, a blade coating method, or the like. Instead of the ring coating method, a dipping method may be used as the method for forming the surface layer portion 361B of the intermediate transfer belt 361. Also in this case, it is possible to improve the productivity of the intermediate transfer belt 361 as compared to the case of using another method.

Figure 5:
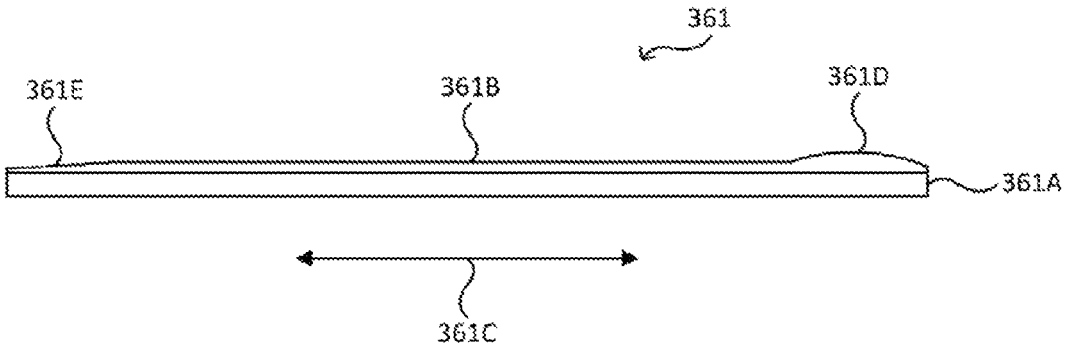
FIG. 5 is a diagram showing the configuration of an intermediate transfer belt of the image forming apparatus according to the embodiment of the present disclosure.

In the case where the surface layer portion 361B of the intermediate transfer belt 361 is formed by the ring coating method or the dipping method, the surface layer portion 361B of the intermediate transfer belt 361 is formed such that a first end portion 361D in a width direction 361C of the intermediate transfer belt 361 is thicker than a second end portion 361E as shown in FIG. 5. The shape of the surface layer portion 361B of the intermediate transfer belt 361 is not limited to the shape in which the first end portion 361D bulges as shown in FIG. 5. For example, the shape of the surface layer portion 361B of the intermediate transfer belt 361 may be a shape inclined linearly from the first end portion 361D toward the second end portion 361E.

The surface layer portion 361B of the intermediate transfer belt 361 is desirably formed of the thermosetting resin that has a Martens hardness of not less than 100 $N/mm^2$ and not greater than 350 $N/mm^2$. That is, in the case where the surface layer portion 361B of the intermediate transfer belt 361 is formed of the thermosetting resin that has a Martens hardness less than 100 $N/mm^2$, sufficient toner releasability is not obtained, so that the efficiency of transferring a toner image to a sheet decreases. In addition, in the case where the surface layer portion 361B of the intermediate transfer belt 361 is formed of the thermosetting resin that has a Martens hardness exceeding 350 $N/mm^2$, coating by the dipping method or the ring coating method becomes difficult.

Meanwhile, the electric charge amount of the toner within the developing device 313 may become non-uniform. Specifically, the electric charge amount of the toner located at the upstream side in the conveyance direction 314C of the toner by the first conveying member 314A becomes smaller than the electric charge amount of the toner located in the downstream side in the conveyance direction 314C. Such non-uniformity of the electric charge amount significantly appears when the toner is supplied into the developing device 313 by the toner supply portion 319. The non-uniformity of the electric charge amount of the toner causes a supply amount of the toner supplied to the photosensitive drum 311 to be non-uniform in the axial direction of the developing roller 316. In addition, the non-uniformity of the electric charge amount of the toner causes a transfer amount of the toner transferred onto the intermediate transfer belt 361 to be non-uniform in the axial direction of the photosensitive drum 311, and causes a transfer amount of the toner transferred onto a sheet to be non-uniform in the width direction 361C of the intermediate transfer belt 361. Thus, if the electric charge amount of the toner within the developing device 313 is non-uniform, the transferability of a toner image from the intermediate transfer belt 361 onto a sheet decreases.

On the other hand, the electric charge amount of the toner transferred onto the surface layer portion 361B of the intermediate transfer belt 361 gradually decreases while the toner is conveyed by the intermediate transfer belt 361. Specifically, regarding the electric charge amount of the toner transferred onto the surface layer portion 361B, an amount of electric charge passing through the surface layer portion 361B to flow out therefrom increases as the layer thickness of the surface layer portion 361B at a location on which the toner is transferred decreases, so that the electric charge amount of the toner decreases by a higher decrease degree. Here, in the case where the surface layer portion 361B of the intermediate transfer belt 361 is formed by the dipping method or the ring coating method, the layer thickness of the surface layer portion 361B at the first end portion 361D at one side in the width direction 361C of the intermediate transfer belt 361 is larger than the layer thickness of the surface layer portion 361B at the second end portion 361E at the other side in the width direction 361C. Thus, a difference in the electric charge amount of the toner in the width direction 361C of the intermediate transfer belt 361 may increase while the toner image is conveyed by the intermediate transfer belt 361.

Specifically, the difference in the electric charge amount of the toner increases in the case where the intermediate transfer belt 361 and the first conveying member 314A are disposed such that the first end portion 361D of the intermediate transfer belt 361 is located at the downstream side in the conveyance direction 314C and the second end portion 361E is located at the upstream side in the conveyance direction 314C. Thus, in an image forming apparatus in which the first end portion 361D or the second end portion 361E of the intermediate transfer belt 361 can be disposed at any of the upstream side and the downstream side in the conveyance direction 314C, if no attention is paid to a positional relationship between the upstream and downstream sides in the conveyance direction 314C and the first and second end portions 361D and 361E in assembling the intermediate transfer belt 361, the transferability of a toner image from the intermediate transfer belt 361 to a sheet is varied in each individual image forming apparatus.

Figure 6:
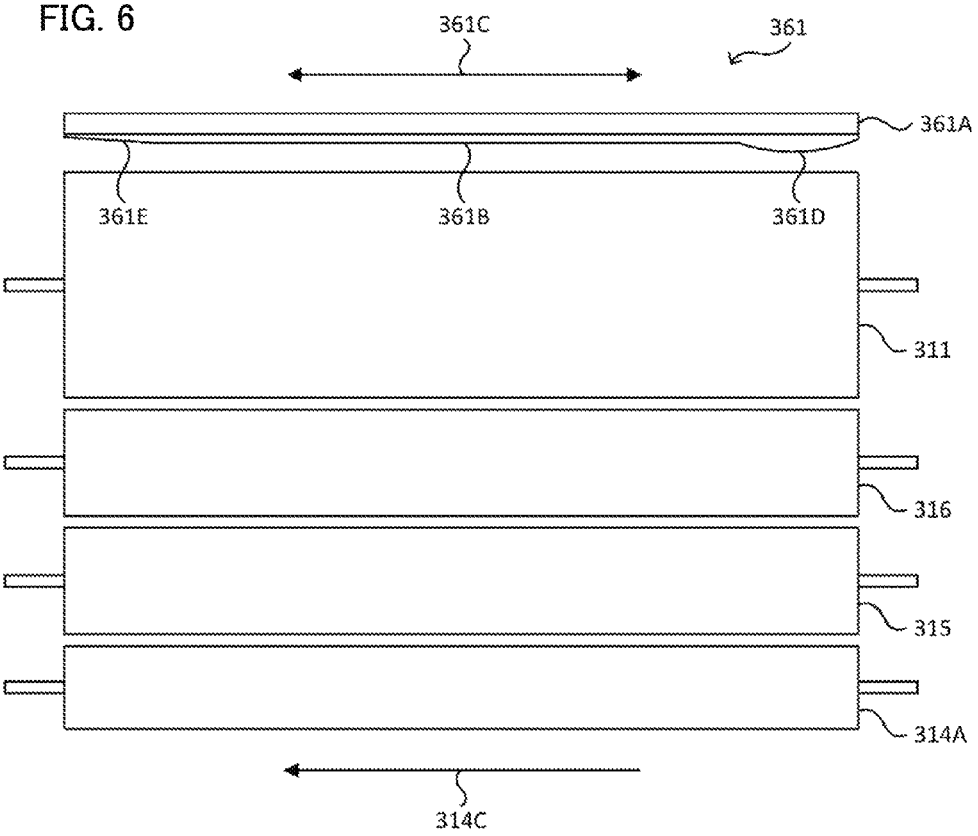
FIG. 6 is a diagram showing a positional relationship between a first conveying member and the intermediate transfer belt in the image forming apparatus according to the embodiment of the present disclosure.

On the other hand, in the image forming apparatus 10 according to the present disclosure, as shown in FIG. 6, the intermediate transfer belt 361 and the first conveying member 314A are disposed such that the first end portion 361D of the intermediate transfer belt 361 is located at the upstream side in the conveyance direction 314C and the second end portion 361E is located at the downstream side in the conveyance direction 314C. FIG. 6 is a diagram in which, for the sake of convenience, the first conveying member 314A, the magnet roller 315, the developing roller 316, the photosensitive drum 311, and the intermediate transfer belt 361 are arranged along a movement path for the toner from the first conveying member 314A to the intermediate transfer belt 361, in order to describe the positional relationship between the intermediate transfer belt 361 and the first conveying member 314A.

Accordingly, the toner that is located in the first containing portion 313D and at the upstream side in the conveyance direction 314C and has a small electric charge amount is transferred onto the surface layer portion 361B at the first end portion 361D of the intermediate transfer belt 361 which first end portion 361D has a large layer thickness. On the other hand, the toner that is located in the first containing portion 313D and at the downstream side in the conveyance direction 314C and has a large electric charge amount is transferred onto the surface layer portion 361B at the second end portion 361E of the intermediate transfer belt 361 which second end portion 361E has a small layer thickness. Thus, a difference in the electric charge amount of the toner in the width direction 361C of the intermediate transfer belt 361 when the toner is transferred at the primary transfer position P1 from the photosensitive drum 311 onto the intermediate transfer belt 361 decreases while the toner is conveyed by the intermediate transfer belt 361. Therefore, the difference in the electric charge amount of the toner in the width direction 361C of the intermediate transfer belt 361 at the secondary transfer position P5 is made uniform, so that the transferability to a sheet improves.

Figure 7:
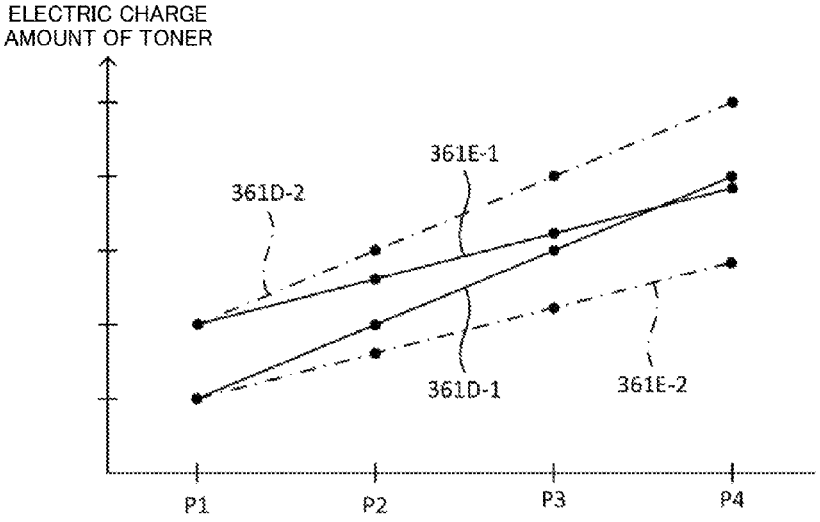
FIG. 7 is a diagram showing transition of an electric charge amount of toner transferred onto the intermediate transfer belt of the image forming apparatus according to the embodiment of the present disclosure.

Here, FIG. 7 shows transitions of electric charge amounts of the yellow toner transferred at the primary transfer position P1 onto the first end portion 361D and the second end portion 361E of the intermediate transfer belt 361, when the yellow toner passes through the primary transfer positions P2 and P4. In FIG. 7, the transitions of the electric charge amounts of the toner in the image forming apparatus 10 are indicated by solid lines 361D-1 and 361E-1. Hereinafter, for convenience of explanation, the positional relationship between the intermediate transfer belt 361 and the first conveying member 314A in the image forming apparatus 10 according to the embodiment of the present disclosure, that is, the positional relationship between the intermediate transfer belt 361 and the first conveying member 314A corresponding to the solid lines 361D-1 and 361E-1, is referred to as "assembly example A.

As shown in FIG. 7, in the assembly example A, at the primary transfer position P1, the electric charge amount of the yellow toner transferred onto the second end portion 361E is larger than the electric charge amount of the yellow toner transferred onto the first end portion 361D. This is because: the toner that is located in the first containing portion 313D of the developing device 313 and at the upstream side in the conveyance direction 314C and has a small electric charge amount is transferred onto the first end portion 361D of the intermediate transfer belt 361; and the toner that is located in the first containing portion 313D of the developing device 313 and at the downstream side in the conveyance direction 314C and has a large electric charge amount is transferred onto the second end portion 361E of the intermediate transfer belt 361.

In addition, as shown in FIG. 7, in the assembly example A, the electric charge amounts of the yellow toner transferred onto the first end portion 361D and the second end portion 361E increase until the yellow toner is conveyed from the primary transfer position P1 to the primary transfer position P2. This is because electric charge is applied from the photosensitive drum 321 to the toner due to a discharge occurring at the primary transfer position P2 and between the photosensitive drum 321 and the primary transfer roller 327, so that the electric charge amount of the toner increases.

Here, as shown in FIG. 7, in the assembly example A, at the primary transfer position P2, the toner transferred onto the first end portion 361D is higher in increase rate of the electric charge amount than the toner transferred onto the second end portion 361E. This is because a decrease amount of electric charge until the toner is conveyed from the primary transfer position P1 to the primary transfer position P2 is larger in the toner transferred onto the second end portion 361E, than in the toner transferred onto the first end portion 361D. Thus, in the assembly example A, the difference in electric charge amount at the primary transfer position P1 between the toner transferred onto the first end portion 361D and the toner transferred onto the second end portion 361E decreases each time the toner passes through the primary transfer position at the downstream side in the conveyance direction 36A. Also regarding cyan toner transferred at the primary transfer position P2, magenta toner transferred at the primary transfer position P3, and black toner transferred at the primary transfer position P4, similarly to the yellow toner, the difference in electric charge amount between the toner transferred onto the first end portion 361D and the toner transferred onto the second end portion 361E decreases each time the toner passes through the primary transfer position at the downstream side in the conveyance direction 36A.

In FIG. 7, transitions of electric charge amounts of the toner in the case where the intermediate transfer belt 361 and the first conveying member 314A are disposed such that a positional relationship opposite to that in the embodiment of the present disclosure is established are indicated by alternate long and short dash lines 361D-2 and 361E-2. That is, the alternate long and short dash lines 361D-2 and 361E-2 indicate transitions of electric charge amounts of the toner in the case where the first end portion 361D of the intermediate transfer belt 361 is located at the downstream side in the conveyance direction 314C and the second end portion 361E is located at the upstream side in the conveyance direction 314C. Hereinafter, for convenience of explanation, the positional relationship between the intermediate transfer belt 361 and the first conveying member 314A corresponding to the alternate long and short dash lines 361D-2 and 361E-2 is referred to as "assembly example B".

As shown in FIG. 7, in the assembly example B, at the primary transfer position P1, the electric charge amount of the yellow toner transferred onto the first end portion 361D is larger than the electric charge amount of the yellow toner transferred onto the second end portion 361E. In addition, in the assembly example B, at the primary transfer position P2, the toner transferred onto the first end portion 361D is higher in increase rate of the electric charge amount than the toner transferred onto the second end portion 361E. Thus, in the assembly example B, the difference in electric charge amount at the primary transfer position P1 between the toner transferred onto the first end portion 361D and the toner transferred onto the second end portion 361E increases each time the toner passes through the primary transfer position at the downstream side in the conveyance direction 36A. Also regarding the cyan toner transferred at the primary transfer position P2, the magenta toner transferred at the primary transfer position P3, and the black toner transferred at the primary transfer position P4, similarly to the yellow toner, the difference in electric charge amount between the toner transferred onto the first end portion 361D and the toner transferred onto the second end portion 361E increases each time the toner passes through the primary transfer position at the downstream side in the conveyance direction 36A.

As described above, in the image forming apparatus, in the case where the intermediate transfer belt 361 having the surface layer portion 361B formed by the dipping method or the ring coating method is used, the difference in the electric charge amount of the toner in the width direction 361C of the intermediate transfer belt 361 at the secondary transfer position P5 changes due to the positional relationship between the intermediate transfer belt 361 and the first conveying member 314A. Specifically, the difference in the electric charge amount of the toner decreases in the case of the assembly example A, and the difference in the electric charge amount of the toner increases in the case of the assembly example B. Thus, in the image forming apparatus 10 according to the embodiment of the present disclosure, the intermediate transfer belt 361 and the first conveying member 314A are assembled in a positional relationship that allows the difference in the electric charge amount of the toner to be decreased. Accordingly, the difference in the electric charge amount of the toner in the width direction 361C of the intermediate transfer belt 361 at the secondary transfer position P5 is made uniform, so that the transferability of a toner image from the intermediate transfer belt 361 to a sheet improves. In addition, occurrence of variation in transferability of a toner image from the intermediate transfer belt 361 to a sheet in each individual image forming apparatus 10 is suppressed.

Meanwhile, in the image forming apparatus 10, the developing device 313 is supplied with the toner by the toner supply portion 319 from the downstream side of the second containing portion 313E in the conveyance direction 314C. Specifically, as shown in FIG. 4, the housing 313A of the developing device 313 has, at the downstream side of the second containing portion 313E in the conveyance direction 314C, an opening portion 313H having an opening through which the toner supplied from the toner supply portion 319 passes. For example, as shown in FIG. 2, the opening portion 313H is provided in an upper surface which covers an upper portion of the second containing portion 313E of the housing 313A. The opening portion 313H may be provided on the side wall of the housing 313A that forms the second containing portion 313E. Accordingly, a time for agitating the toner by the second conveying member 314B is ensured before the toner supplied from the toner supply portion 319 to the developing device 313 is supplied from the first conveying member 314A to the magnet roller 315. Therefore, the electric charge amount of the toner becoming non-uniform within the developing device 313 is suppressed.

Other Embodiments

In the image forming apparatus 10, in the case where the photosensitive layer portion 311B of the photosensitive drum 311 is formed by the dipping method or the ring coating method, the present disclosure may be applied with the photosensitive drum 311 regarded as the image conveying portion in the present disclosure. In this case, the magnet roller 315 and the developing roller 316 are another example of the image forming portion in the present disclosure. A position at which the toner is supplied to the surface of the photosensitive layer portion 311B by the developing roller 316 is another example of the image forming position in the present disclosure. The primary transfer roller 317 is another example of the first transfer member in the present disclosure. The primary transfer position P1 is another example of the transfer position in the present disclosure. The intermediate transfer belt 361 is another example of the transfer target medium in the present disclosure.

In addition to an indirect transfer type image forming apparatus using the intermediate transfer belt 361 such as the image forming apparatus 10, the present disclosure may be also applied to a direct transfer type image forming apparatus that transfers a toner image formed on the surface of the photosensitive layer portion 311B of the photosensitive drum 311, directly onto a sheet.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner supply portion;

a toner containing portion configured to contain toner supplied from the toner supply portion;

a first conveying member configured to convey the toner in a predetermined conveyance direction within the toner containing portion, thereby agitating and charging the toner while conveying;

an endless transfer belt including a surface layer portion having a first end located at an upstream side in the conveyance direction and a second end located at a downstream side in the conveyance direction, the first end having a larger layer thickness than the second end, the transfer belt being configured to convey a toner image formed on a surface of the surface layer portion at a predetermined image forming position, from the image forming position to a transfer position for transfer to a transfer target medium, the transfer position being separated from the image forming position in a direction perpendicular to the conveyance direction; and an image forming portion configured to form, at the image forming position, the toner image on the surface layer portion of the transfer belt by using the toner charged while being conveyed by the first conveying member.

2. The image forming apparatus according to claim 1, further comprising a first transfer member configured to transfer the toner image on the surface layer portion, onto the transfer target medium at the transfer position, wherein the image forming portion includes: an image carrier having a surface on which an electrostatic latent image is formed; a developing portion configured to develop the electrostatic latent image formed on the image carrier, by using the toner being conveyed by the first conveying member; and a second transfer member configured to transfer the toner image formed on the image carrier by the developing portion, onto the surface of the surface layer portion of transfer belt at the image forming position.

3. The image forming apparatus according to claim 2, wherein the transfer belt is an intermediate transfer medium in which a plurality of the toner images are respectively transferred onto the surface of the surface layer portion at each of a plurality of the image forming positions, and a plurality of the toner containing portions, a plurality of the first conveying members, a plurality of the image carriers, a plurality of the developing portions, and a plurality of the second transfer members are provided in corresponding relation to the plurality of the image forming positions, respectively.

4. The image forming apparatus according to claim 3, wherein the transfer belt includes a base layer portion formed of a thermoplastic resin and the surface layer portion formed of a thermosetting resin.

5. The image forming apparatus according to claim 1, wherein the surface layer portion is formed by a dipping method or a ring coating method.

6. The image forming apparatus according to claim 1, further comprising:

a second conveying member configured to convey the toner in a direction opposite to the conveyance direction, within the toner containing portion, wherein the toner containing portion includes a first containing portion in which the toner and the first conveying member are contained; a second containing portion in which the toner and the second conveying member are contained; a separation wall separating the first containing portion and the second containing portion from each other; a first connection portion connecting the first containing portion and the second containing portion at a downstream side of the separation wall in the conveyance direction; a second connection portion connecting the first containing portion and the second containing portion at an upstream side of the separation wall in the conveyance direction; and an opening portion provided at a downstream side of the second containing portion in the conveyance direction and having an opening through which the toner supplied from the toner supply portion passes.

* * * * *